US010180026B2

(12) United States Patent
Peck et al.

(10) Patent No.: US 10,180,026 B2
(45) Date of Patent: Jan. 15, 2019

(54) FLEXIBLE PORTABLE SECURITY BAG WITH AN ELONGATE ZIPPER

(71) Applicants: Robert Michael Peck, Ganesvoort, NY (US); Jonathan Kinas, Aventura, FL (US); Avin Samtani, Miami Beach, FL (US)

(72) Inventors: Robert Michael Peck, Ganesvoort, NY (US); Jonathan Kinas, Aventura, FL (US); Avin Samtani, Miami Beach, FL (US)

( * ) Notice: Subject to any disclaimer, the term of this patent is extended or adjusted under 35 U.S.C. 154(b) by 0 days.

(21) Appl. No.: 15/478,746

(22) Filed: Apr. 4, 2017

(65) Prior Publication Data

US 2017/0234056 A1 Aug. 17, 2017

Related U.S. Application Data

(63) Continuation-in-part of application No. 14/850,430, filed on Sep. 10, 2015, now Pat. No. 9,822,578, which is a continuation-in-part of application No. 14/253,338, filed on Apr. 15, 2014, which is a (Continued)

(51) Int. Cl.

| | |
|---|---|
| ***E05G 1/00*** | (2006.01) |
| ***E05G 1/024*** | (2006.01) |
| ***E05G 1/026*** | (2006.01) |
| ***E05G 1/04*** | (2006.01) |

(52) U.S. Cl.

CPC ..... *E05G 1/005* (2013.01); *E05G 1/024* (2013.01); *E05G 1/026* (2013.01); *E05G 1/04* (2013.01)

(58) Field of Classification Search

CPC .. E05G 1/00; E05G 1/005; E05G 1/02; E05G 1/04; E05B 65/0075; E05B 65/52; E05B 73/00

See application file for complete search history.

(56) References Cited

U.S. PATENT DOCUMENTS 1,982,813 A * 12/1934 Jacobi ..... E05B 65/52 383/91
3,530,919 A * 9/1970 May ..... A63B 55/00 206/315.4

(Continued)

*Primary Examiner* — Christopher J Boswell
(74) *Attorney, Agent, or Firm* — Richard Allison

(57) ABSTRACT

A portable, universally fitting, stylish, lockable security box or bag that integrally affixes to a an object such as the support or cross bar on a frame of a beach lounge chair, a stroller, bike, wheelchair or similar member where it is desirable to protect your valuables on a stationary or a larger movable object. The security bag is a device preferably comprised of a flexible flap component and a main bottom component which encloses the valuables of the user. When the security bag is positioned over an elongate object, such as the support bar of a chair, stroller or other object, the security bag can be affixed to the elongate object by employing a locking mechanism to close the security bag around the support object. The security bag includes an elongate zipper closure to provide a secure internal cavity formed by the two main components which makes this device simple and unique. The exterior design of the security bag makes universal fit a reality and protects the valuables of the user by securing them to a larger object and also hiding them from the view of third parties.

20 Claims, 12 Drawing Sheets

Related U.S. Application Data continuation-in-part of application No. 13/413,017, filed on Mar. 6, 2012.

(56) References Cited

U.S. PATENT DOCUMENTS

| | | | | |
|---|---|---|---|---|
| 5,531,082 | A * | 7/1996 | Wolk | A45C 13/20 70/18 |
| 7,086,255 | B2 * | 8/2006 | Reason | A44B 19/301 211/4 |
| 7,422,131 | B2 * | 9/2008 | Cohen | A45F 3/04 224/651 |
| 9,822,578 | B2 * | 11/2017 | Peck | E05G 1/005 |
| 2006/0016532 | A1 * | 1/2006 | Volk | A45C 13/18 150/102 |
| 2014/0014009 | A1 * | 1/2014 | Crockwell | E05G 1/06 109/53 |
| 2016/0053525 | A1 * | 2/2016 | McMurray | E05G 1/005 150/130 |

* cited by examiner

FLEXIBLE PORTABLE SECURITY BAG WITH AN ELONGATE ZIPPER

PRIORITY CLAIM

The present application is a continuation-in-part application of co-pending application Ser. No. 14/850,430 filed on Sep. 10, 2015 which is a continuation-in-part of co-pending application Ser. No. 14/253,338 filed on Apr. 15, 2014 which is a continuation-in-part application of application Ser. No. 13/413,017 filed on Mar. 6, 2012.

DESCRIPTION OF PRIOR ART

In general, examples of the concept of having a lock box that attaches to a fixed object are known. For example, it is known to provide an elongate cable lock that is wrapped around a secure pole or post and then the cable lock is secured to the storage container. In this type of locking container, one end of the cable may be fixed as part of the storage container while the other end is releasably retained in a locking mechanism or both ends may be locked in the storage container. The following patents and patent applications are illustrative of the known prior art in this area.

- U.S. Pat. No. 4,061,395 issued to Boole in 1977 for "Portable Drawer Assembly".
- U.S. Pat. No. 7,305,858 issued to Wu in 2007 for "Security box"
- U.S. Pat. No. 4,573,332 issued to Ma in 1986 for "Portable Security box"
- U.S. Pat. No. 7,607,933 issued to Shai in 2009 for "Portable tool box locker"
- U.S. Pat. No. 6,085,671 issued to Kerr in 2000 for "Lock box"
- U.S. Pat. No. 5,531,082 issued to Wolk in 1996 for "Portable Security Case"
- U.S. Pat. No. 4,971,390 issued to McGinley in 1990 for "Safety Locker Drawer for use with a chair"
- U.S. Pat. No. 4,667,491 issued to Lokken in 1987 for "Portable Travel Safe"
- U.S. Pat. No. 2,755,748 issued to Abell in 1953 for "Portable Lock box"

BACKGROUND OF THE INVENTION

This invention relates to a self-contained flexible bag, safe, lockable container, or lock box for securing valuables and more particularly to a portable, lockable security bag that may be secured to a fixed object. It has long been known that when people are at a place of relaxation or recreation (beach, pool, camp, park, or other outdoor activity) people are concerned that their valuables are safe and secure. This invention is a simple way to secure valuables to a fixed object in a stylish, universal fit, with a specially designed lockable container. This invention will greatly reduce the worry a person has concerning the security of their valuables, such as when they go for a swim, wherein previously one would hide objects in sneakers or under a towel.

The present invention relates to a portable, lockable security bag such as a security box, self-contained safe, lockable container, portable security safe or similar device. The above examples are all similar in concept but lack the simplicity and features which are important elements which the present invention provides. Cable locks, Sliding trays, complex mounting mechanisms, multiple component assemblies, and materials subject to degradation are all embodied in the prior innovations. The present invention utilizes innovative features to solve the prior problems by providing a novel solution.

The traditional safe is used to store objects in such a way as to restrict access to these objects. Typically, safes are meant to be permanent objects which are highly impregnable except to users with access to the safe's inner contents by way of a key or knowledge of a combination. However, in order to keep the safe, and its contents, from being easily removed, traditional safes have been intentionally designed to be heavy, bulky, and difficult to move. In certain instances, individuals may desire to restrict access to objects, such as their wallet, keys, phone, firearm, or other items, while they are somewhere in which it would be impractical to bring a traditional safe.

Thus, one may desire to have a portable safe to store valuables while temporarily out of view of their valuables, such as when swimming, enjoying recreational activities, or relaxing on beach or pool lounge chairs. However, because it would be undesirable for the portable safe to be too portable while the user is using the safe to restrict access to the safe's contents, it is also desirable to provide a lockable storage container that is self-contained and removably attachable to a variety of other fixed or secure elements such as patio chairs, strollers, bikes or structural members. People commonly carry valuables such as cell phones, watches, wallets, glasses, room keys, etc. with them. When a person decides to do an activity where it is not convenient or where they cannot take all of their valuables with them, the person must decide what to do to make sure their valuables are not stolen when they are temporarily out of view of them.

Prior to this invention, one had to use a complex lock box with a chain or mounting brackets to store their valuables. Alternatively, locking boxes were placed on door knobs or were limited to use on the non-supporting areas of a specific type of chair, but did not have the flexibility to be secured to any desirable elongate object nor the space to store valuables from multiple people. Prior to this invention, there was no safe capable of true portability combined with the ability to attach to structural elements in a truly removable fashion. Without a portable safe, the only option is to hide valuables out of sight, such as under a towel, and hope the valuables are there when they return. Despite market demand, prior attempts to address this problem have fallen short as a result of a failure to address the problem in the novel manner disclosed herein. A simplified design of the type disclosed herein with innovative features exemplifies an invention that has been desired in the marketplace and is more fully described herein.

SUMMARY OF THE INVENTION

The portable, lockable security box of the present invention is specifically designed to store valuables at a variety of locations, such as the beach, pool or other recreation area. The unique, one of a kind security box of the present invention self-fastens to an elongate object, including a support member or bar such as on a lounge chair or stroller, a boat or golf cart safety rail, a secured rope, or even a bicycle frame. The security box includes at least a portion that opens up and can be closed over the bar of a lounge chair frame, stroller or other support element and can then be securely locked. Other possible uses include shopping carts, wheel chairs, ATVs, or on closet rods or any other item having a secure support member. In order to accommodate a support element, the security box ingeniously includes a versatile support cavity.

In one embodiment of the present invention, the support cavity is made up of an arcuate portion, a corner lip, and a straight portion on each of two side openings in the security box. In an example of one generally preferred form of the invention, the support cavity fits on a wide variety of support elements, such as a support with a diameter of approximately 2 inches. The support bar may be square or a round bar with a diameter of approximately 2 inches or less, such as lounge chair support bar frames or stroller frame. This unique security box is self-contained and completely portable. Unlike prior attempts to solve the problem addressed by the present invention, this security box does not require permanent fixation to the support element, such as being bolted on or screwed down, and does not require assembly, such as the insertion of a pivotable arm, cable or a pawl. The present invention is ideal for use at the beach, park or pool, wherein the security box can be filled with any valuables of allowable size that the owner would like to secure, enclosed over any elongate object that is part of the lounge chair, stroller or a structural member and then locked using the locking mechanism that comes with the lockable security box (ex. Integral Briefcase Lock) or even an external padlock. In an alternate embodiment of the present invention, the locking mechanism consists of an RFID arrangement where the owner is able to activate the lock by using an RFID chip on a bracelet or a key type card.

In yet another embodiment of the present invention, the security bag portion of the invention is formed of a flexible material which is preferably cut or tear resistant to resist attempts to cut the security bag from around the secure object or otherwise obtain access to the contents of the security bag. In this embodiment, the invention includes a top flap type member and a bottom component that are flexible. The top member may be wrapped around a secure object such as a support bar. The flap component includes a locking member that fits into a complementary lock member on the front surface of the bottom component such that the flap component is locked around the secure object. In this embodiment, the top of the bottom component includes the flexible security bag portion. The security bag portion includes a top member that may be zipped or otherwise closed so that when the flap component is locked around the support member, the interior of the security bag portion is not visible or accessible.

The present invention is designed to provide a level of security at the beach, park, or pool so that the owner can leave the stored items unattended and not have to worry about them as they would if the same items were left out in the open. This security box is a theft deterrent device which, if used properly, should decrease the probability that valuables are stolen at the beach, park or pool. It is submitted that a potential thief is less likely to attempt to break open the present invention and potentially draw attention to their activities rather than quickly search unattended towels and shoes that are likely hiding places for valuables. Additionally, the nature of the materials of the present invention do not allow the thief to see what, if anything is located in the portable, lockable security box, thereby further reducing the likelihood that a thief will target the lockable security box rather than searching for easier targets.

In a preferred form of the present invention, the security box is specifically designed to be temporarily affixed to lounge chairs by use of integral side openings which surround the elongate support bar on the back of a lawn or beach chair. Placing the security box on the back of a chair, wherein it would not be easily visible from the front of the chair, has aesthetic utility as well as providing an additional level of security due to the decreased visibility, especially if the chair were situated against a wall or sand dune. Furthermore, the exterior shape of one form of the lock box is generally a 3D ellipse, ovoid or bulbous shaped and has multiple rounded edges so as to not interfere with the operation of the device to which it is attached while maximizing the internal storage space. Furthermore, the top and bottom components of this embodiment are designed to close flush with each other, as opposed to one being larger than the other, which decreases the likelihood of a snag or injury by the user of the security box. The support cavity is configured with two versatile side openings to engage a variety of cross-sectional shapes of elongate support members to which it can attach. As described more fully below, the security box preferably includes a greater length between the side openings of the support cavity than the front to back dimension.

In an alternate form of the present invention, the security bag is a flexible member that is specifically designed to be temporarily affixed to lounge chairs by use of integral side openings which surround the elongate support bar on the back of a lawn or beach chair. Placing the flexible security bag on the back of a chair, wherein it would not be easily visible from the front of the chair, has aesthetic utility as well as providing an additional level of security due to the decreased visibility, especially if the chair were situated against a wall or sand dune. In this embodiment, the flexible security bag is a generally rectangular-shaped member that includes a plurality of loops and pockets on the exterior surface to allow the flexible security bag to be tied to a bike or other member while being transported to the desired location. The exterior pockets may also be used to transport a cell phone or other device during transport to the desired location. The security portion of this embodiment is preferably formed as part of the bottom component. The top surface of the security portion of this embodiment may be closed with a zipper or similar closure to prevent access or visibility to the contents of the security bag. The flexible flap component on the top component is sufficiently long to allow the flap component to be wrapped around nearly any commonly encountered support bar while still limiting the space between the flap component and the top surface of the security portion. The top end of the flap includes a lock element that complementarily fits into a lock component on the front exterior surface of the bottom component.

The present invention relates generally to a simplified, portable, universal fit, lockable container that attaches to a fixed object to store valuables. An embodiment of the present invention preferably includes a top component that connects to the bottom component by means of a hinge which has a built in support cavity that will fit a variety of different sized fixed objects such as the metal frame supports of a beach lounge chairs with an integral compartment that will store valuables such as cell phones, wallets, watches, glasses, room keys, and other valuables which is secured by an integrated lock The present invention includes a locking system under which the security bag is securely attached to a fixed object and is also releasably clasped or an RFID system is used which will prevent unauthorized entry to the lockable container when the user is swimming or enjoying recreational activities.

DETAILED DESCRIPTION OF THE DRAWINGS

Figure 1:
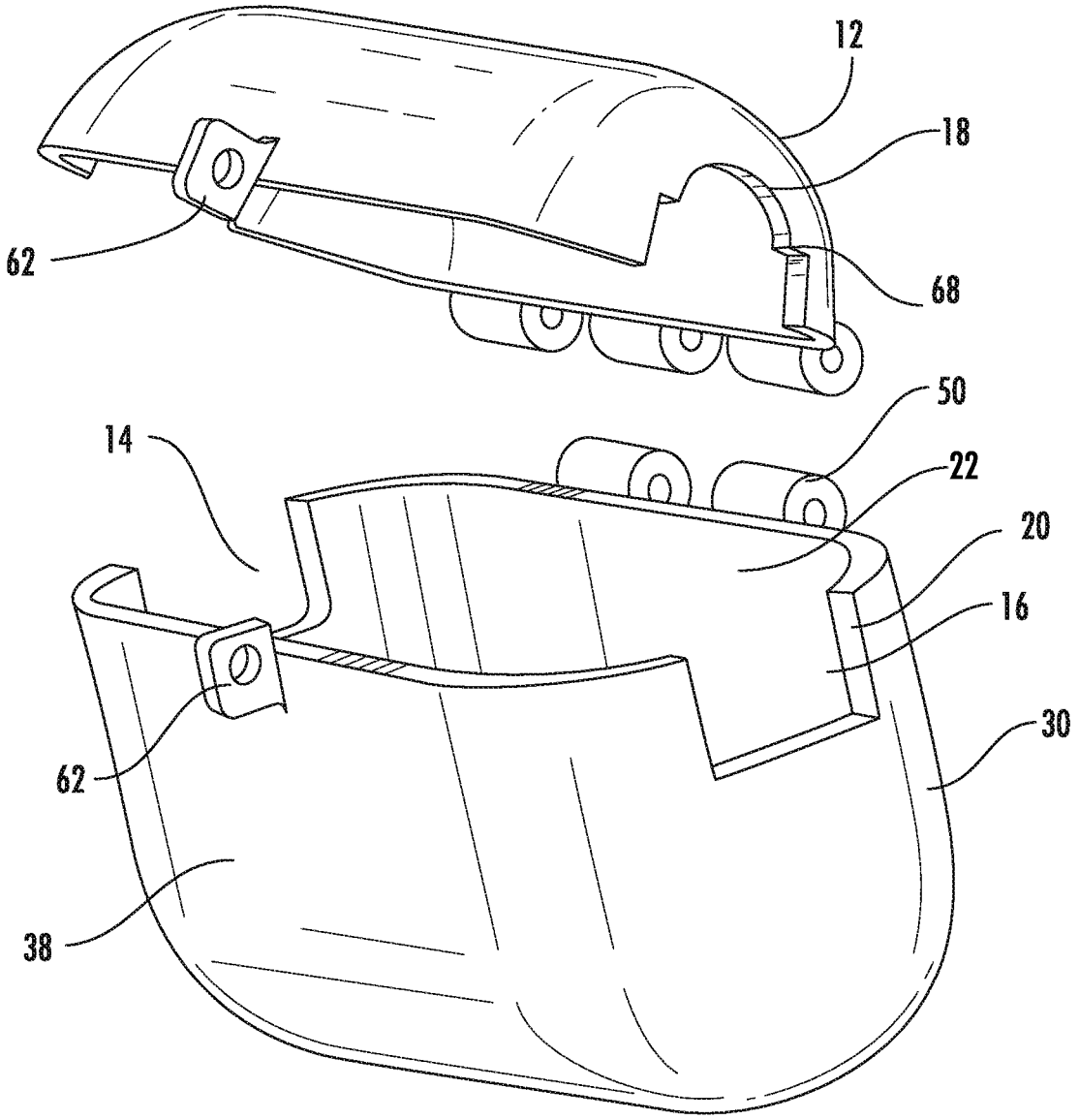
FIG. 1 illustrates an exploded perspective front view of the two main components of the security bag and the side openings.
Figure 2:
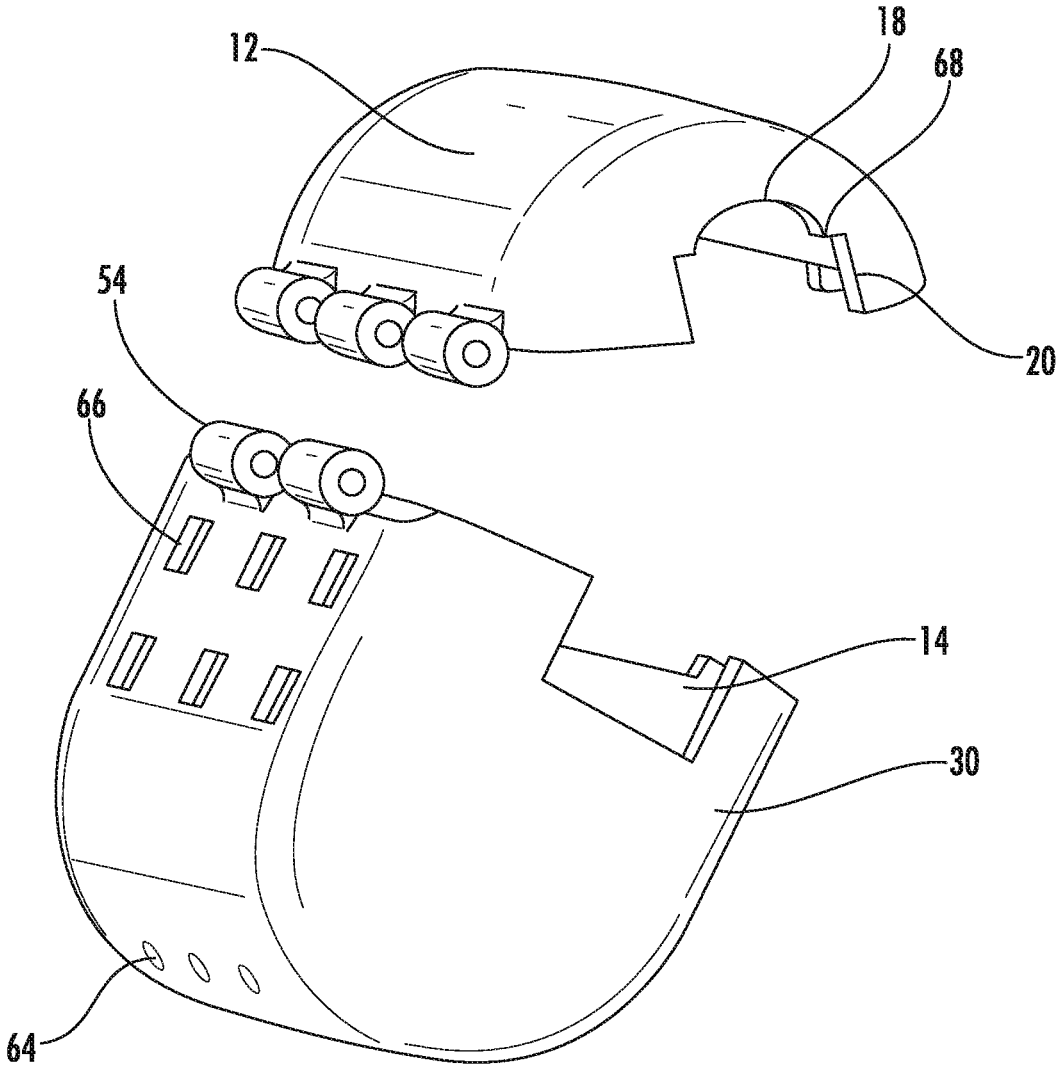
FIG. 2 illustrates an exploded perspective view from the back of the two main components of the security box and the side openings.
Figure 3:
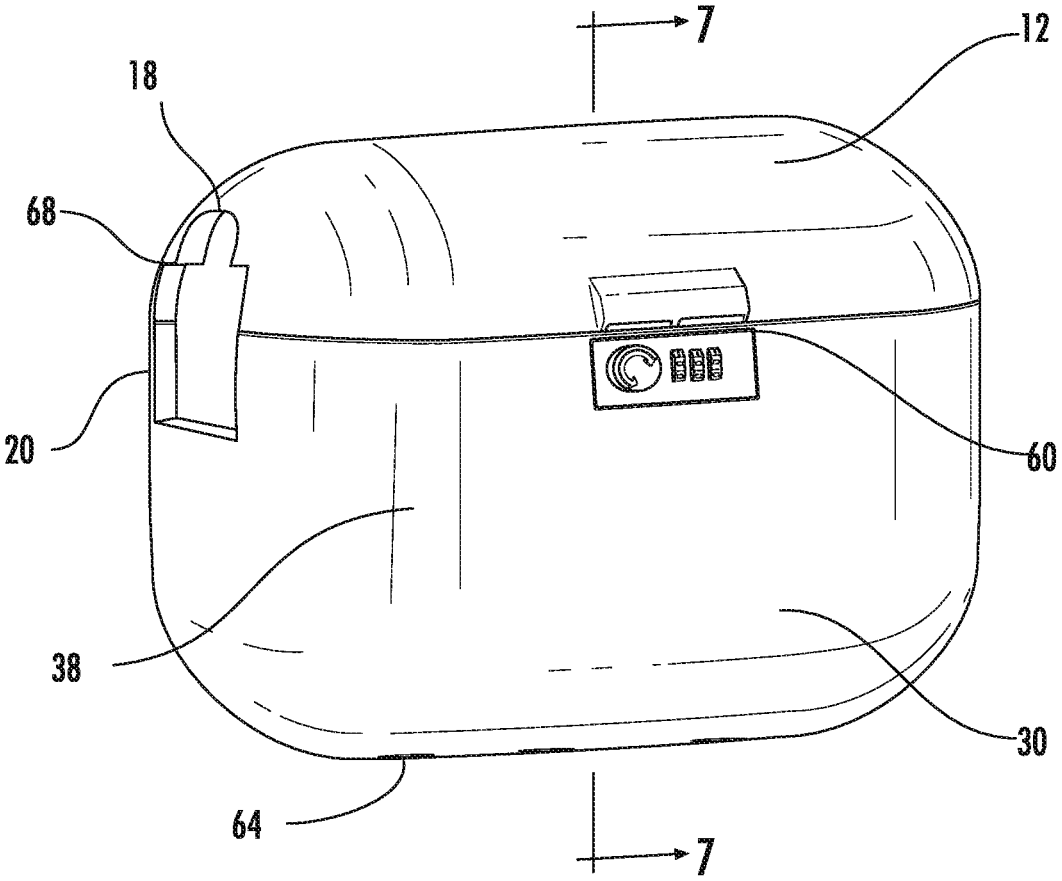
FIG. 3 shows a front view of both main components when assembled.
Figure 4:
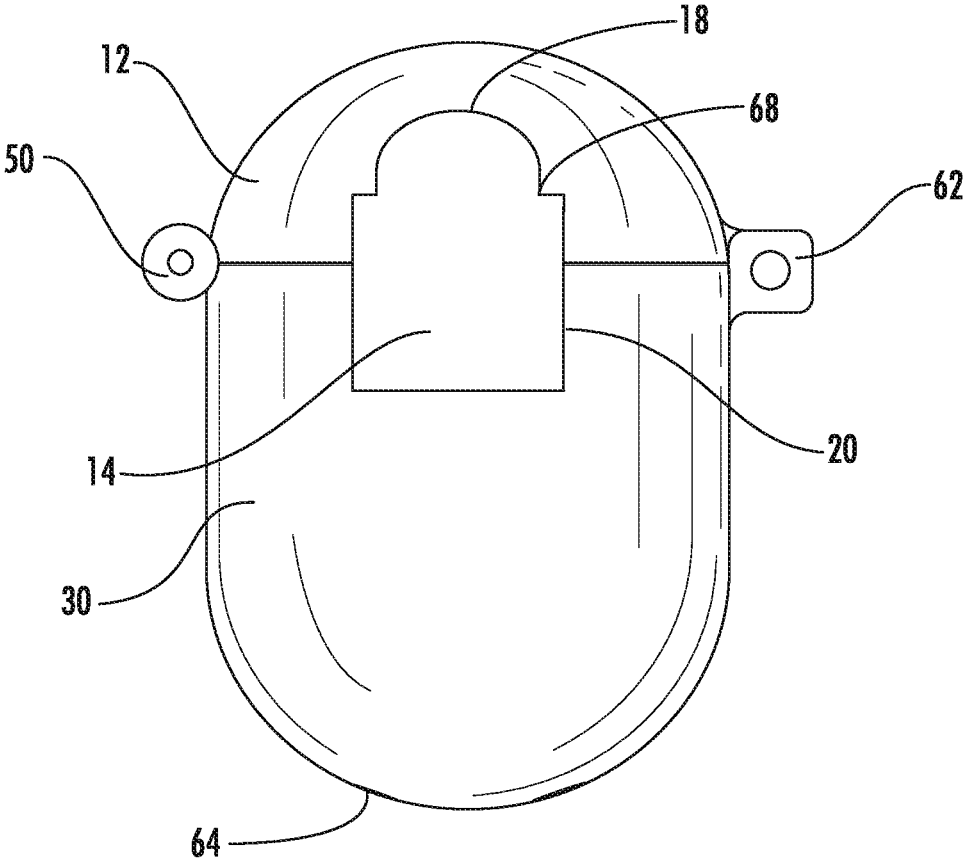
FIG. 4 shows a side view of both main components when assembled.
Figure 5:
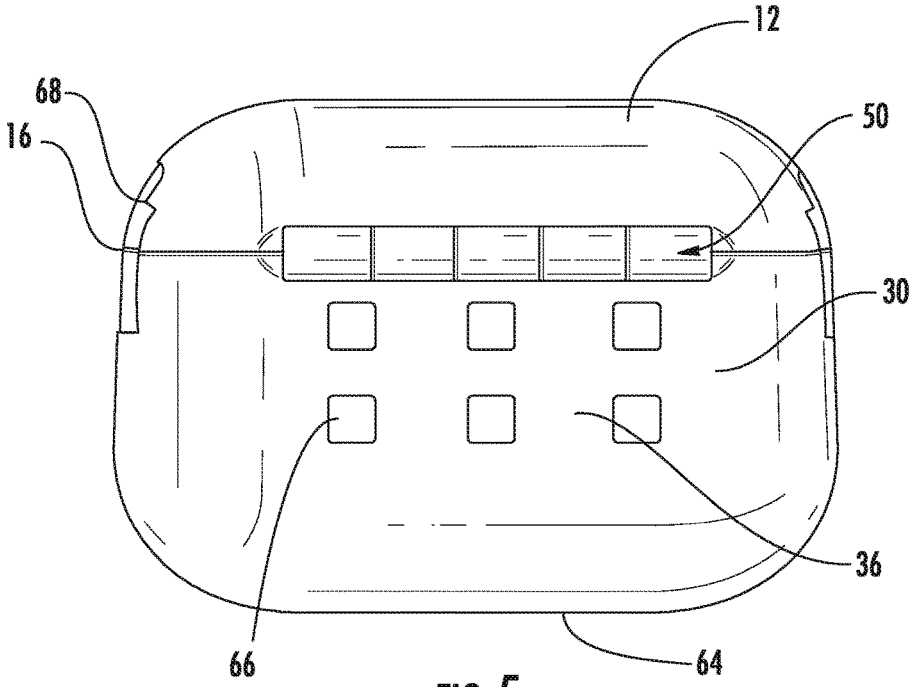
FIG. 5 shows a rear view of both main components when assembled.

As shown in FIGS. 1 and 2 the security box 10 of the present invention has a top component 12 which connects to the bottom component 30 through an integrally attached hinge 50. The hinge 50 operates by tapping a tapered pin 52 into each side of the hinge extensions 44. The top component 12 is hinged and movable relative to the bottom component 30 to close the top component 12 onto the top of the bottom component 30. As shown in FIG. 1, the hasps 62 of the locking mechanism 60 come together so they may be locked with a padlock to secure the user's valuables inside. Alternately, as shown in FIGS. 3 and 7, the lockable security box 10 may have a self-contained locking mechanism 60, such as an integral briefcase style locking mechanism as described more fully below.

As best shown in FIGS. 1, 2, 4 and 7, the top component 12 includes opposed side openings 14 and 16. In a preferred form of the present invention, the side openings 14 and 16 are formed by the combination of the upper arcuate portion 18, corner lip 68, straight side portions 20 of the top component 12 and the generally straight sides and generally rectangular shape of the side openings 14 and 16 of the bottom component 30. The combination of the arcuate portion 18, the corner lip 68, and the straight side portions 20 allows the side openings 14 and 16 to engage a variety of cross sectional shapes of elongate support bars 70. When the support bar 70 has a circular cross section, the support bar 70 will typically contact the upper arcuate portion 18 of the side openings 14 and 16. When the support bar 70 has a rectangular, oval or other shaped cross section, the support bar 70 will contact either the corner lip 68 or both the upper arcuate portion 18 and the corner lip 68 of the side openings 14 and 16 to reduce the movement of the lockable security box 10 relative to the support bar 70 when the lockable security box 10 encloses the support bar 70. In this configuration, the security box cannot be removed from the support bar without cutting though the support bar or breaking the hinge or locking mechanisms of the present invention.

Figure 7:
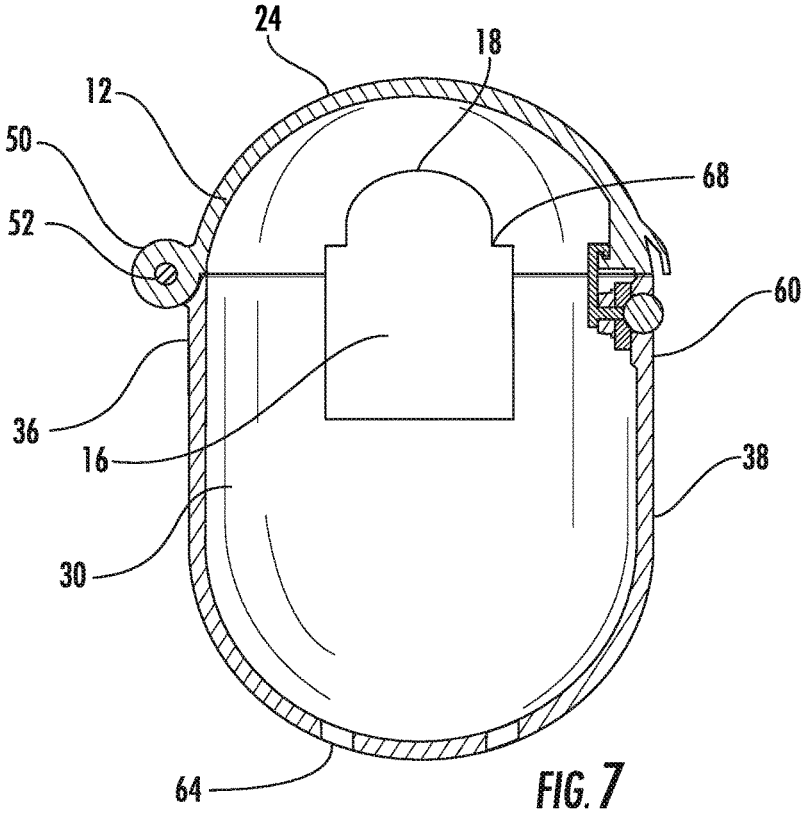
FIG. 7 shows a cross sectional view of a security box taken generally along the plane generally bisecting the embodiment of the invention shown in FIG. 3.

As shown in FIGS. 1, 2 and 7, the top component 12 includes an inner surface 22 and an outer surface 24. In a preferred form of the present invention, the inner surface and the outer surface of the top component 12 are preferably of generally uniform thickness, although, it is anticipated that the thickness may vary to reinforce certain sections of the top component or to accommodate various manufacturing processes. The top component is preferably manufactured of an ABS material, although a variety of other strong and durable materials such as Poly Carbonates, nylon composites, carbon fibers or certain other high strength materials may be used to provide the attributes desired in the present invention. As shown in FIGS. 1, 2 and 7, the top component has a generally elongate lengthwise dimension between the side openings 14 and 16 and is generally u-shaped in cross sectional shape between the front surface 26 and the back surface 28 of the top component. The height of the top component is generally chosen to be sufficient to accommodate the majority of cross sectional sizes of intended support bar 70 in the side openings 14 and 16, while providing sufficient structural integrity around the support bar 70 and in combination with the bottom component 30 to provide secure engagement with the support bar. The back surface 28 of the top component 12 preferably includes a plurality of outwardly extending hinge extensions 54 having circular openings there through to securely retain the tapered pins 52 therein when the lockable security box is assembled. The front surface 26 of the top component 12 includes at least a portion of the locking mechanism 60 thereon. As shown in FIG. 1, a hasp member 62 extends forwardly from the front surface 26 of the top component 12 in a manner to allow the side by side positioning of the hasp 62 from the bottom component 30 to allow the insertion of a portion of a lock through each of the hasps to securely close the lockable security box 10. As also described in this application and shown in FIG. 7, the locking mechanism 60 may also consist of a self-contained lock similar to the types of locks used for bicycles, storage units or similar devices. In this form of the locking mechanism 60, a combination lock type feature extends or retracts a hasp member 62 that is engaged in a recessed portion located along the inner surface 22 of the top component 12.

As shown in FIGS. 1, 2 and 7, the bottom component 30 includes an inner surface 32 and an outer surface 34. In a preferred form of the present invention, the inner surface and the outer surface of the bottom component 30 are preferably of generally uniform thickness, although, it is anticipated that the thickness may vary to reinforce certain sections of the bottom component or to accommodate various manufacturing processes or even to provide an internal support surface for the valuables of the user. The bottom component 30 is preferably manufactured of an ABS material, although a variety of other strong and durable materials such as Poly Carbonates, nylon composites, carbon fibers or certain other high strength materials may be used to provide the attributes desired in the present invention. As shown, the bottom component 30 has a generally elongate lengthwise dimension between the side openings 14 and 16 and is generally ovoid, elliptical or u-shaped in cross sectional shape between the front surface 36 and the back surface 38 of the bottom component 30. In the preferred form of the present invention, the inner surface 32 of the bottom component preferably forms a recessed area that has sufficient size to retain the valuables from multiple people. The height of the bottom component 30 is generally chosen to provide sufficient interior volume to accommodate the majority valuables typically carried by beach, park or pool goers. As with the top component 12, the bottom component 30 preferably includes a greater lengthwise dimension than the width dimension to provide a bottom component which extends along the lengthwise dimension of an elongate support bar 70. The bottom component 30 includes the bottom portions of the side openings 14 and 16. In the preferred form of the side openings 14 and 16, the shape on the bottom component is preferably rectangular to accommodate a variety of sizes of cross sectional shapes of the typical elongate support bar 70 while providing sufficient structural integrity around the support bar 70 and in combination with the top component 12 to provide secure engagement with the support bar 70. The back surface 36 of the bottom component 30 preferably includes a plurality of outwardly extending hinge extensions 54 having circular openings there through to securely retain the tapered pins 52 therein when the lockable security box 10 is assembled. As further shown in FIG. 2, the bottom surface of the bottom component 30 may include a plurality of drainage holes 64 to allow for drainage if the interior compartment of the lockable security box 10 gets wet. FIG. 2 also shows the back surface 36 of the bottom component as including a plurality of square box shaped openings 66 which are carved out and can be punched through to create a place where fasteners may be affixed if deemed necessary by a consumer.

The front surface 38 of the bottom component 30 includes at least a portion of the locking mechanism 60 thereon. As shown in FIG. 1, a hasp member 62 may extend forwardly from the front surface 38 of the bottom component 30 in a manner to allow the side by side positioning of the hasp 62 from the top component 12 to allow the insertion of a portion of a lock through each of the hasps to securely close the lockable security box 10. As also described in this application and shown in FIGS. 3 and 7, the locking mechanism 60 may also consist of a self-contained lock similar to the types of locks used for bicycles, storage units or similar devices. In this form of the locking mechanism 60, a combination lock type feature engages a hasp member 62 that extends upwardly from the inner surface 32 of the bottom component 30 and is engaged in a recessed portion located along the inner surface 22 of the top component 12. Also as shown in the drawings, a handle type member may extend from the front surface 26 of the top component 12 to provide the user with an element to grasp as the security box 10 is opened or closed. An example of a preferred form of the present invention, the bottom of the interior surface area of the bottom section 30 and top section 12 of the lockable security box 10 is approximately 60 square inches security accommodate phones, wallets, sunglasses etc. from the typical user. A preferred form of the lockable security box preferably has a general dimension of approximately inches by 6.5 inches by 5.5 inches with an approximate size of 375 cubic inches.

Figure 6:
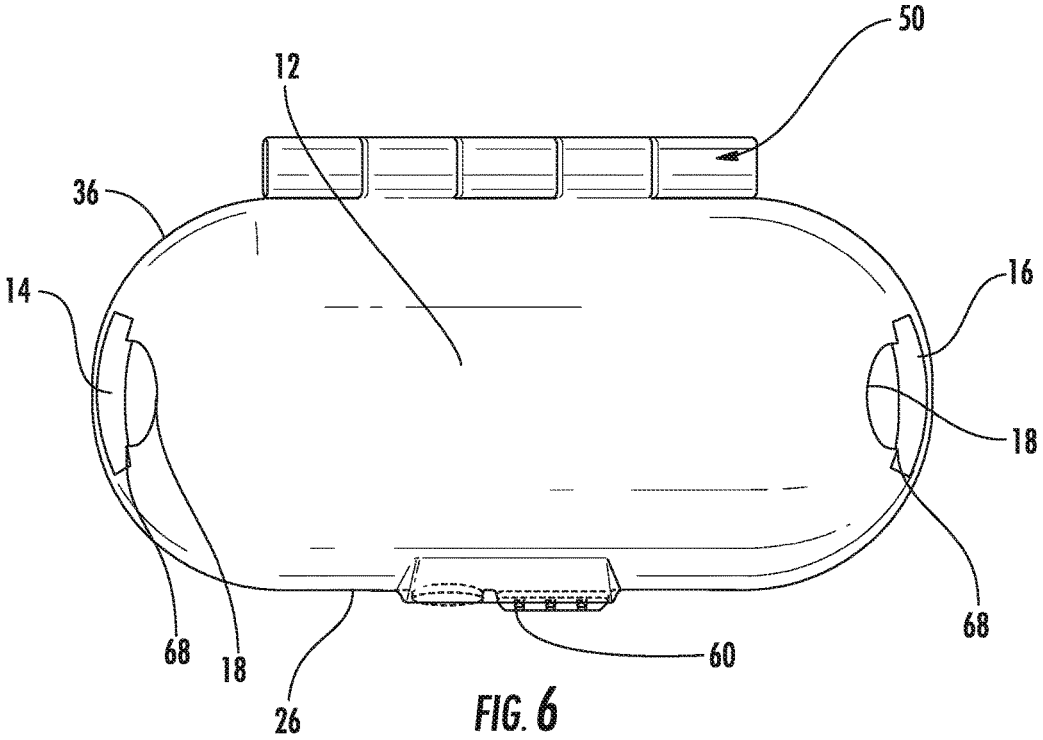
FIG. 6 shows a top view of both main components when assembled.
Figure 8:
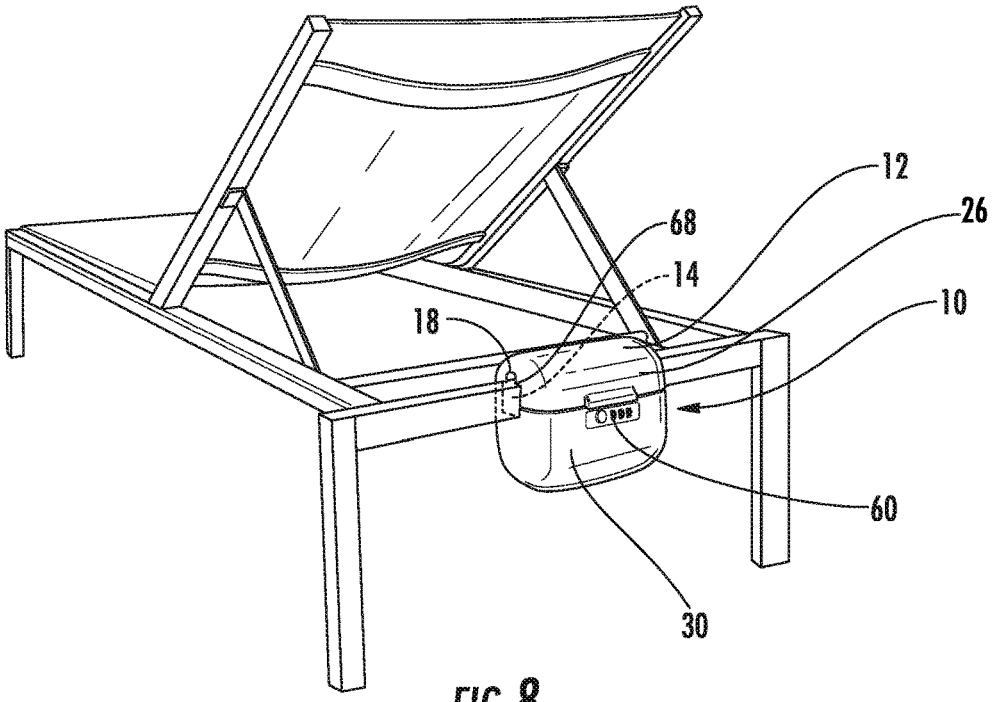
FIG. 8 is a perspective view of the present invention attached to the support bar of a lawn chair.
Figure 9:
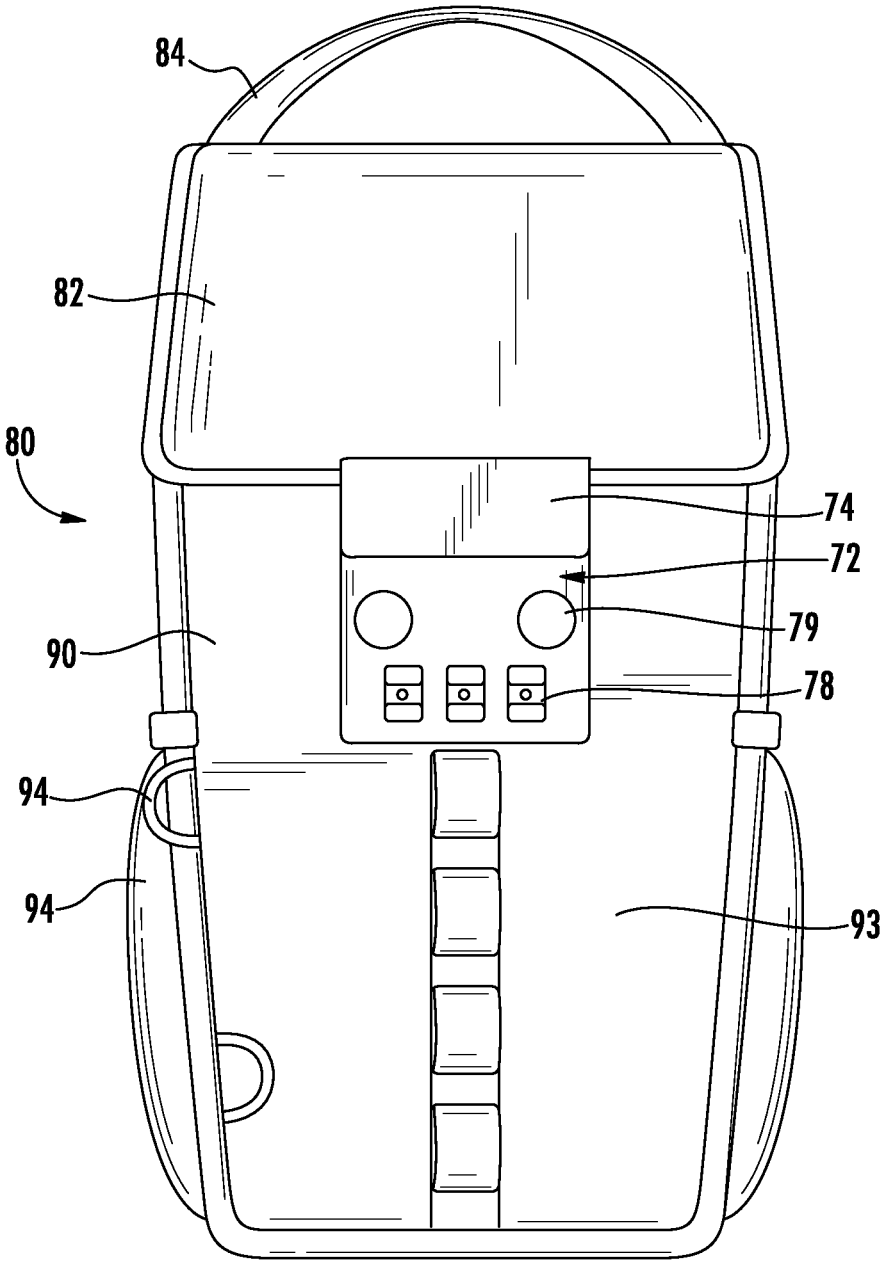
FIG. 9 is a front perspective view of an alternate form of the present invention.

FIGS. 6 and 8 are illustrative of the top and perspective views of a preferred form of the present invention. FIG. 8 shows the ability of support bar 70 running all the way through the invention through the side openings 14 and 16 to allow for the fixed object, such as the support bar 70, to center the gravitational pull of the bottom component 30 of the lockable security box 10 and its contents to the middle of the invention eliminating lopsidedness. As shown in the drawings, this feature is accomplished through the combination of the arcuate portion 18, corner lip 68 of the top component 12 and the generally straight sides and generally rectangular shape of the side openings 14 and 16 of the bottom component 30. Because the lockable security box 10 encloses around the support bar 70 and the support bar 70 has no free ends, the lockable security box 10 is retained on the desired structure until the present invention is opened by the user. Similarly, because the components of the lockable security box 10 are formed of a material that does not allow the contents of the box to be visible therethrough and the side openings of the box are shaped to minimize the ability to see into the box through the side openings, the contents are not readily viewable without opening the lockable security box.

As shown in FIGS. 9-12, an alternate form the security bag 80 of the present invention has a top flap component 82 which releasably connects to the bottom component 90 through an integrally attached locking mechanism 72. The security bag 80 is preferably constructed of a flexible and cut or tear resistant material such as a high density nylon fabric. This allows the user to fold or store the security bag in a compact manner during transport or prior to use and then unfold or open the security bag 80 to insert the desired valuables. The flap component is integrally attached and movable relative to the back surface of the bottom component 90. The top surface of the flap component 82 includes a handle 84 thereon to allow the user to easily transport the security bag 80 prior to attachment of the security bag to the support bar 70. As shown, the handle 84 may be positioned widthwise or depthwise along the top surface of the flap component 82. As shown in the drawings, when the top flap component 82 is folded over and secured into the locking mechanism 72, a pair of side openings 86 and 87 are formed between the interior of the top flap component and the top surface 92 of the bottom component 90 to securely retain the security bag 80 on the support bar 70 such that the support bar extends through the side openings 86 and 87.

Figure 10:
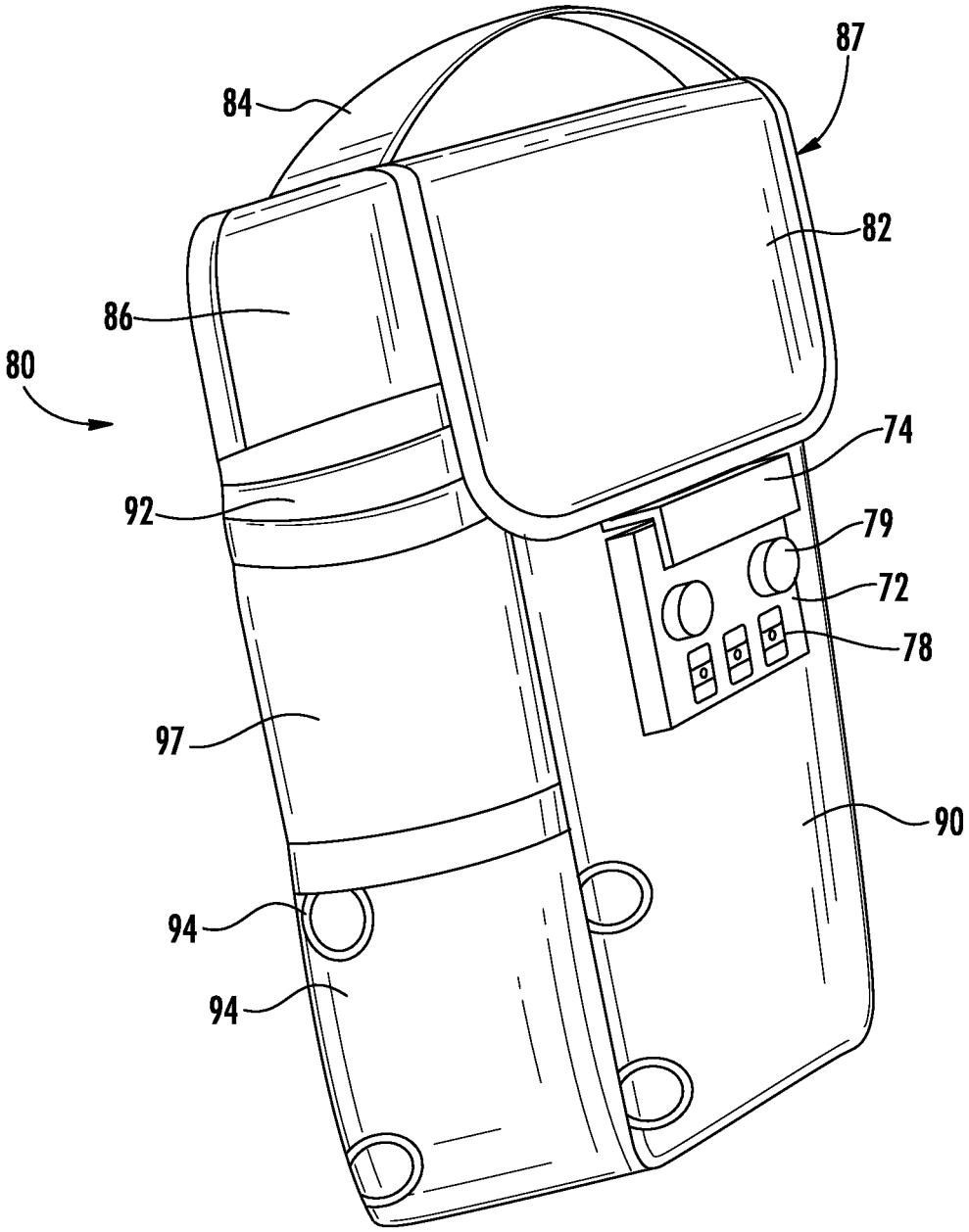
FIG. 10 is a side perspective view of the alternate form of the present invention shown in FIG. 9.

As best shown in FIG. 10, the flap component 82 forms opposed side openings 86 and 87 when it is folded over the bottom component 90. In a preferred form of the present embodiment, the size of the side openings 86 and 87 are directly related length of the flap component such that the side openings are preferably snug or not overly loose around the support bar 70 to prevent someone from reaching into the space around the support bar to attempt to steal the contents of the security bag 80. The width of the flap component 82 is preferably chosen to have sufficient width to securely retain the support bar therein and more preferably to be approximately as wide as the width of the bottom component 90 for aesthetic reasons as well as to provide further protection for the contents of the security bag 80. In a preferred form of the flap component 82, the width of the flap component is approximately equal to or slightly less than the height or length of the flap component. Additionally, the width of the flap component is preferably about twice as great as the distance between the front and back surfaces of the bottom component and the height of the flap component is greater than twice the between the front and back surfaces of the bottom component. The use of the flexible flap component 82 in this embodiment allows the side openings 86 and 87 to engage a variety of cross sectional shapes of elongate support bars 70. In this configuration, the security bag cannot be removed from the support bar without cutting though the support bar or breaking the locking mechanisms of the present invention.

Figure 11:
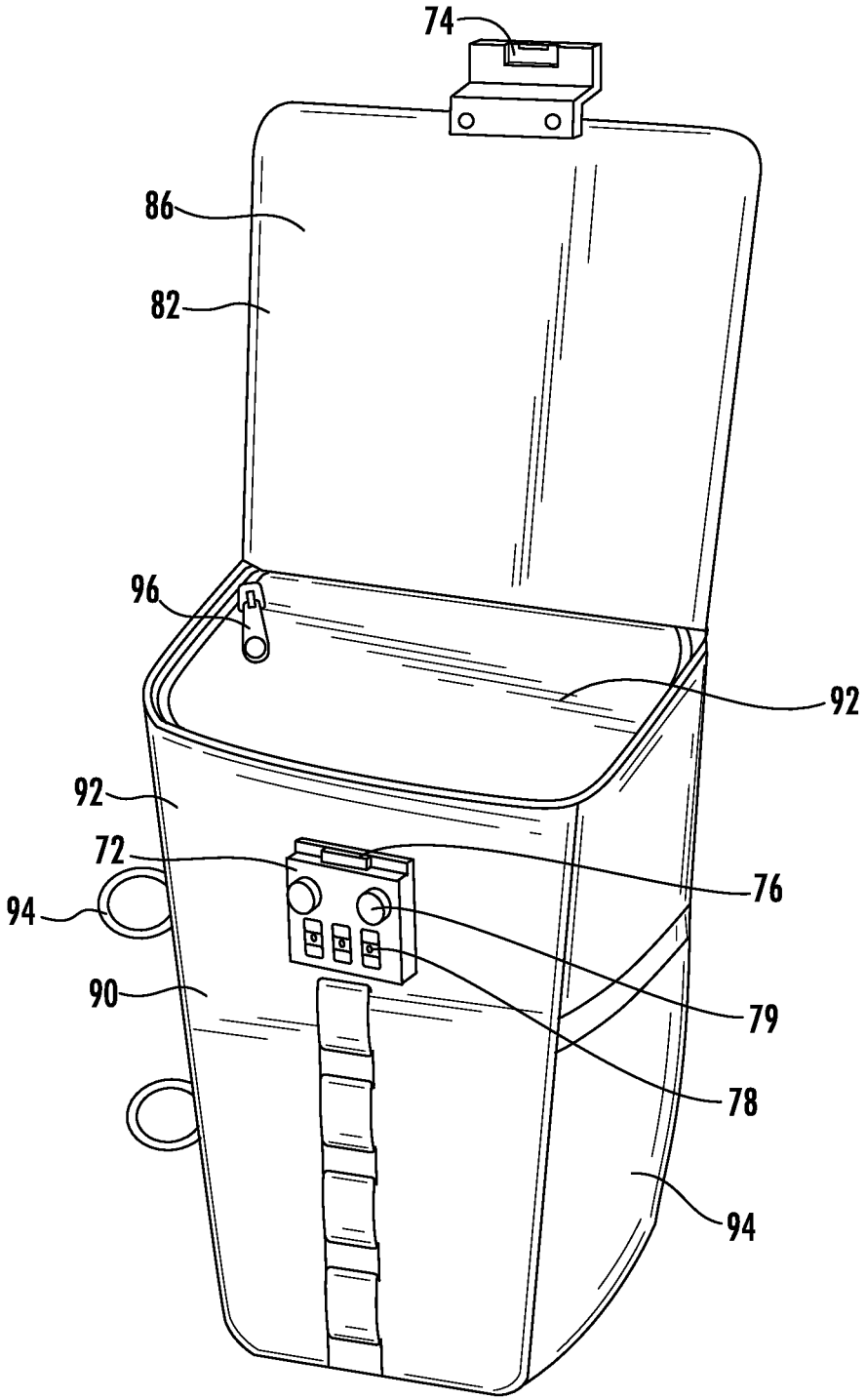
FIG. 11 is a front perspective view of the embodiment shown in FIG. 9 showing the flap component extended.
Figure 12:
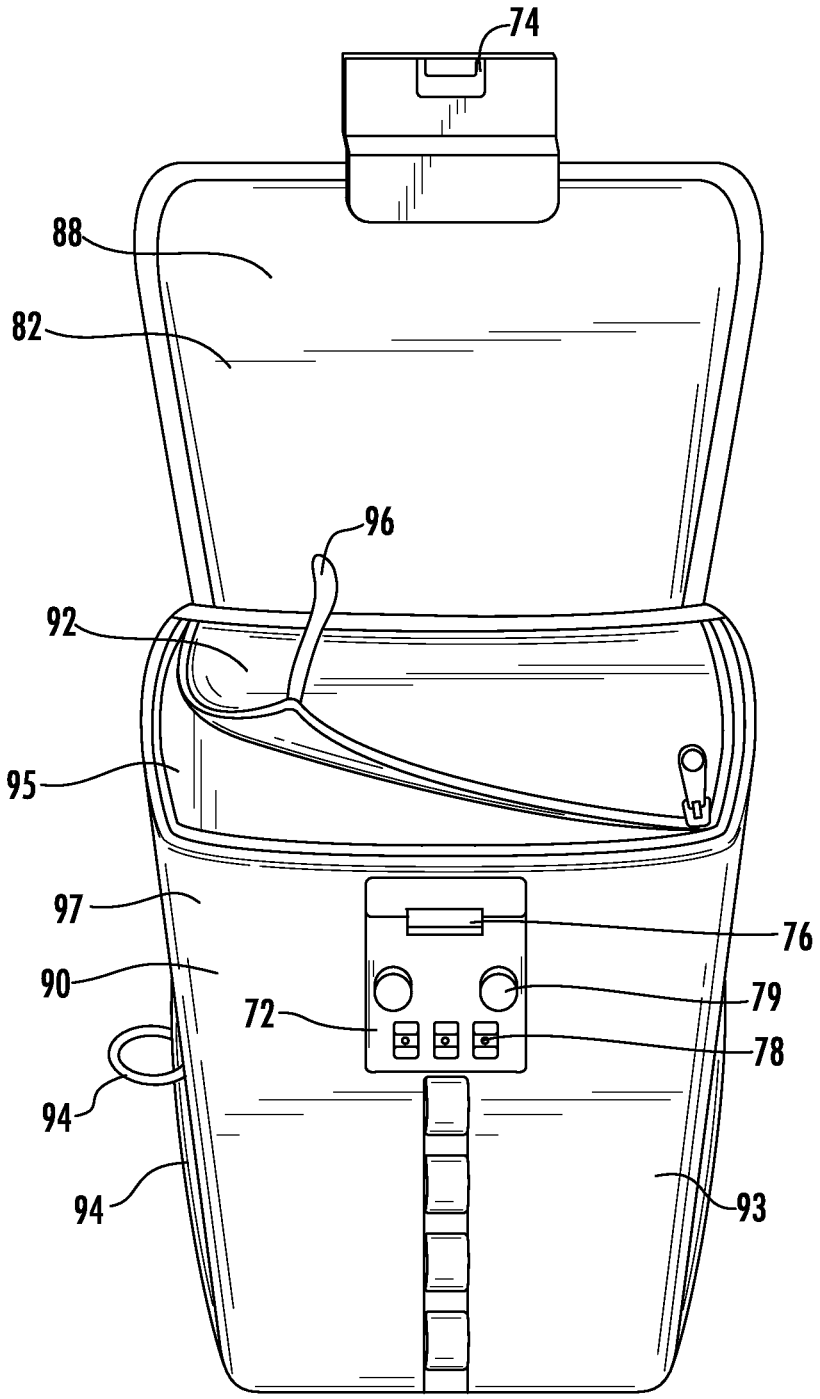
FIG. 12 is a front perspective view of the embodiment shown in FIG. 9 showing the interior of the security bag with the flap component extended.

As shown in FIGS. 11 and 12, the free end of the flap component 82 preferably includes a clasp member 74 integrally connected thereto. The front surface 93 of the bottom component 90 includes at least a portion of the locking mechanism 72 thereon. As shown in FIG. 11, the clasp member 74 extends forwardly from the inner surface 88 of the flap component 82 when the flap component is extended upwardly in an open position. When the flap component 82 is folded and moved to a closed position wherein the side openings 86 and 87 are formed, the clasp member 74 is preferably positioned to extend into a recessed area 76 of the locking mechanism 72. As discussed above with respect to the prior embodiment, a variety of locking mechanisms may be used to secure the flap component 82 to the bottom component 90. In the form of the locking mechanism 72 shown with this embodiment, a combination lock type feature 78 with movable buttons 79 extends or retracts to engage the clasp member 74 in the recessed area 76 located along the front surface 93 of the bottom component 90.

As shown in the drawings, the bottom component 90 of this embodiment includes an inner surface 95 and an outer surface 97. In a preferred form of the present invention, the outer surface 97 of the bottom component 90 preferably includes a plurality of rings and/or mesh type pockets thereon the allow the user to secure the security bag to the strut of a bike, other means of transport or objects having an elongate support member prior to its use as a security bag and to carry cell phones or other items in an accessible manner during transport. Also as shown in the drawings, a handle type member 84 may extend from the top surface of the flap component 82 to provide the user with an element to grasp as the security bag 80 is transported.

As shown, the bottom component 90 has a generally rectangular or elongate lengthwise dimension between the side openings 86 and 87 and is preferably has a greater top to bottom distance than the distance between the front and back surface or the width dimension. It is anticipated that the security bag 80 may be constructed in a variety of configurations depending on the intended use of the security bag to store different valuables. The height of the bottom component 90 is generally chosen to provide sufficient interior volume to accommodate the majority valuables typically carried by beach, park or pool goers. As with the flap component 82, the bottom component 90 preferably includes a greater side or lengthwise dimension than the width dimension from the front to back to provide a bottom component which extends along and is oriented along the lengthwise dimension of an elongate support bar 70. A preferred form of the lockable security bag preferably has a general dimension of approximately 7 inches tall with a depth dimension from the front surface 93 to the back surface of about 3 inches by about 6 inches wide at the top and about 4 inches wide at the bottom. Although not shown, the side or corner edges of the bottom component 90 may include reinforcing wires or threads to further reduce the ability of a person to tear or penetrate the security bag 80 of this embodiment and the security bag 80 may be rectangular or square in general overall shape.

The front surface 93 of the bottom component 90 includes at least a portion of the locking mechanism 72 thereon. As shown, the clasp member 74 may extend forwardly from the inner surface 88 of the flap component 82 in a manner to allow the positioning of the clasp 74 into the recessed area 76 of the locking mechanism 72 to securely close the lockable security bag 80. As also described above, the locking mechanism 72 may also consist of a self-contained lock similar to the types of locks used for bicycles, storage units or similar devices. In this form of the locking mechanism 72, a combination lock type feature 78 controls the engagement of the clasp member 74 in the recessed area 76 and one or more buttons 79 may be manipulated to engage or release the clasp member 74. An example of a preferred form of the present invention, the bottom of the interior surface area of the bottom section 90 and zippered top closure 96 of the lockable security bag 80 may be approximately 60 square inches to securely accommodate phones, wallets, sunglasses etc. from the typical user.

FIGS. 10 and 11 are illustrative of the top and perspective views of the alternate embodiment of the present invention. FIG. 11 shows the use of a zippered top closure 96 that provides further security for the contents of the security bag 80. The zippered top closure 96 securely closes the top surface of the bottom component 90 to provide a fully contained and enclosed storage cavity for the valuables of the user. Additionally, zippers, hook and loop combinations, ties or other closure mechanisms may be aligned to be positioned along the middle edge of either the front or back of the bottom component 90 such that when the flap component 82 is securely locked in the locking mechanism, the zippers are located away from the side openings 86 and 87. This feature provides an additional level of security for the contents by preventing access to the zippers when the flap component is in the locked position.

In this alternate embodiment, the support bar 70 extends under the flap component 82 and above the top closure 96 of the bottom component 90 and through the side openings 86 and 87 to allow for the fixed object, such as the support bar 70, to center the gravitational pull of the bottom component 90 of the lockable security bag 80 and its contents to the middle of the invention eliminating lopsidedness. As shown in the drawings, this feature is accomplished through the flexibility and relative width of the flap component 82 as well as the preferably small amount of movement allowed along the inner surface 88 of the flap component 82. Because the lockable security bag 80 encloses around the support bar 70 and the support bar 70 has no free ends, the lockable security bag 80 is retained on the desired structure until the present invention is opened by the user. Similarly, because the components of the lockable security bag 80 are formed of a material that does not allow the contents of the bag to be visible therethrough and the top closure 96 of the bottom component 90 is closable, there is nothing visible through the side openings 86 and 87, the contents are not readily viewable without opening the lockable security bag.

As shown in FIGS. 13-16, another form of the security bag 110 of the present invention has a top flap component 112 which releasably connects to the bottom component 120 through an integrally attached locking mechanism 102. The security bag 110 is preferably constructed of a flexible and cut or tear resistant material such as a high density nylon fabric. The top flap component 112 is configured to wrap around a support bar B to secure the security bag 110. The bottom component 120 serves primarily as the storage component of the security bag to securely store valuables therein. The flexibility of the security bag 110 allows the user to fold or store the security bag in a compact manner during transport or prior to use and then unfold or open the security bag 110 to insert the desired valuables. The flap component 112 is integrally attached and movable relative to the back surface 123 of the bottom component 120. The top surface or exterior surface 113 of the flap component 112 includes a handle 114 thereon to allow the user to easily transport the security bag 120 prior to attachment of the security bag to a secure support bar. As shown, the handle 114 may be positioned widthwise or depthwise along the top surface of the flap component 112. An additional handle 115 may be located on the back surface of the security bag 110. As shown in the drawings, when the top flap component 112 is folded over and secured into the locking mechanism 102, a pair of side openings 116 and 117 are formed adjacent to the folded interior surface 111 of the top flap component 112. The security bag 110 is securely retained on a support bar such that the support bar extends through the side openings 116 and 117.

Figure 14:
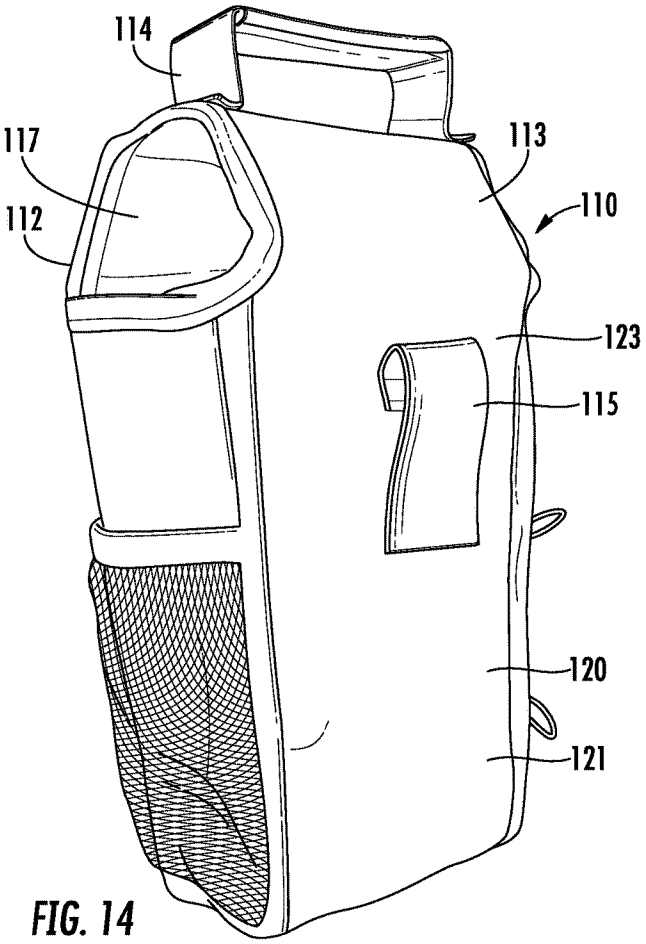
FIG. 14 is a back perspective view of the alternate form of the present invention shown in FIG. 13.

As best shown in FIG. 14, the flap component 112 includes an interior surface 111 and an exterior surface 113. The interior surface 111 of the flap component 112 includes the zippered closure 130 thereon as more fully described below. The flap component 112 forms opposed side openings 116 and 117 when it is folded over to engage the clasp member 104 in the recessed area of the lock 106 on the front surface 123 of the bottom component 120. In a preferred form of the present embodiment, the size of the side openings 116 and 117 are directly related to the length of the flap component such that the side openings are preferably snug or not overly loose around a desired diameter of a support bar to prevent someone from reaching into the space around the support bar to attempt to steal the contents of the security bag 110. The width of the flap component 112 is preferably chosen to have sufficient width to securely retain the support bar therein and more preferably to be approximately as wide as the width of the bottom component 120 for aesthetic reasons as well as to provide further protection for the contents of the security bag 110. In a preferred form of the flap component 112, the width of the flap component is approximately equal to or slightly less than the height or length of the flap component. Additionally, the width of the flap component is preferably about twice as great as the distance between the front surface 123 and back surface 121 of the bottom component and the height of the flap component is greater than twice the distance between the front and back surfaces of the bottom component 120 to maximize the storage capacity of the inner surface of the bottom component 120. The use of the flexible flap component 112 in this embodiment allows the side openings 116 and 117 to engage a variety of cross sectional shapes of elongate support bars. In this configuration, the security bag cannot be removed from the support bar without cutting though the support bar or breaking the locking mechanisms of the present invention. Furthermore, the flexibility of the top flap component 112 allows the security bag 110 to be secured along round, square or otherwise shaped secure members and to hang downwardly from the support bar.

Figure 13:
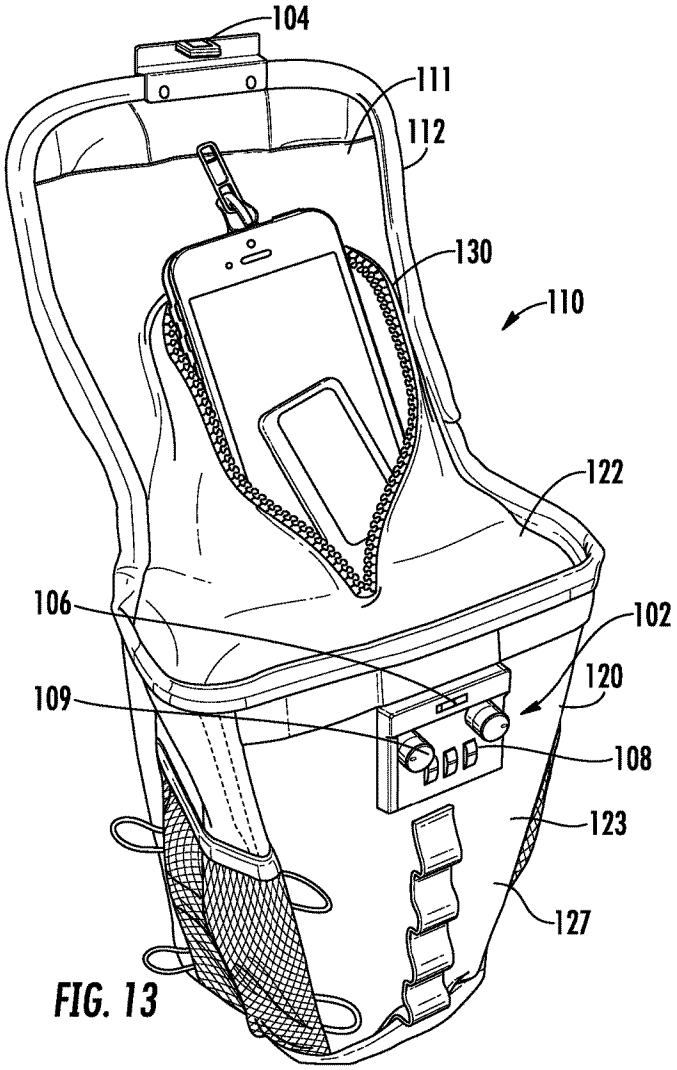
FIG. 13 is a front perspective view of an alternate form of the present invention.
Figure 16:
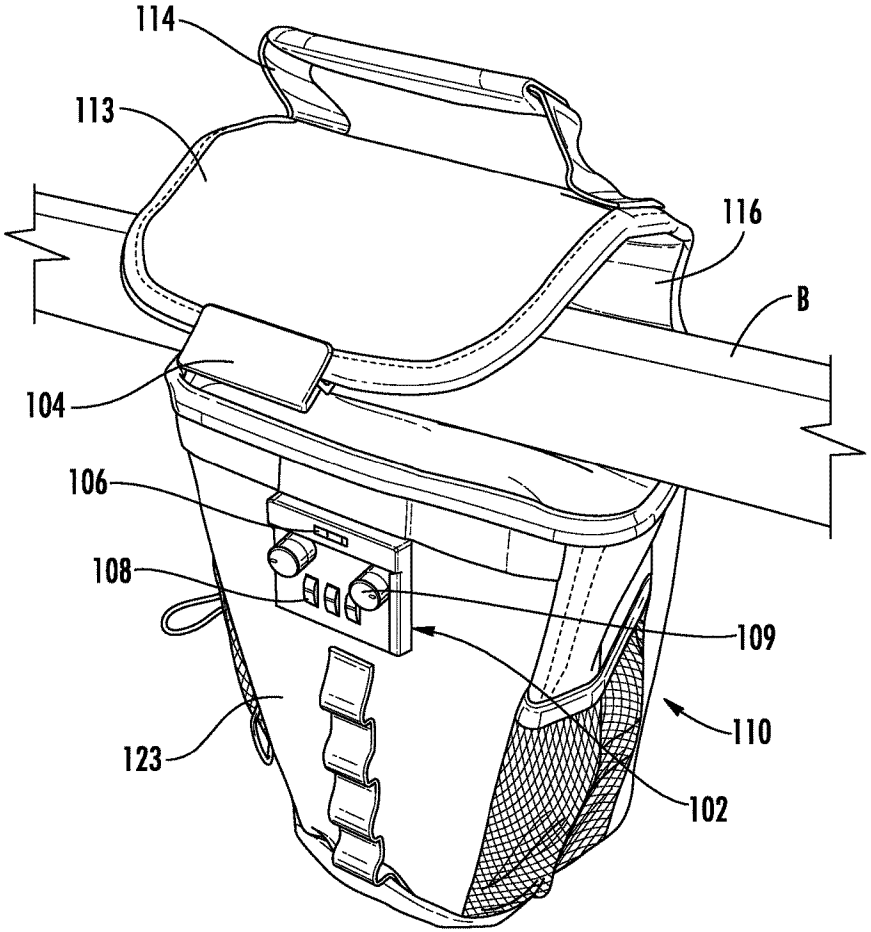
FIG. 16 is a front perspective view of the embodiment shown in FIG. 13 showing the top flap component folded over a support bar.
Figure 15:
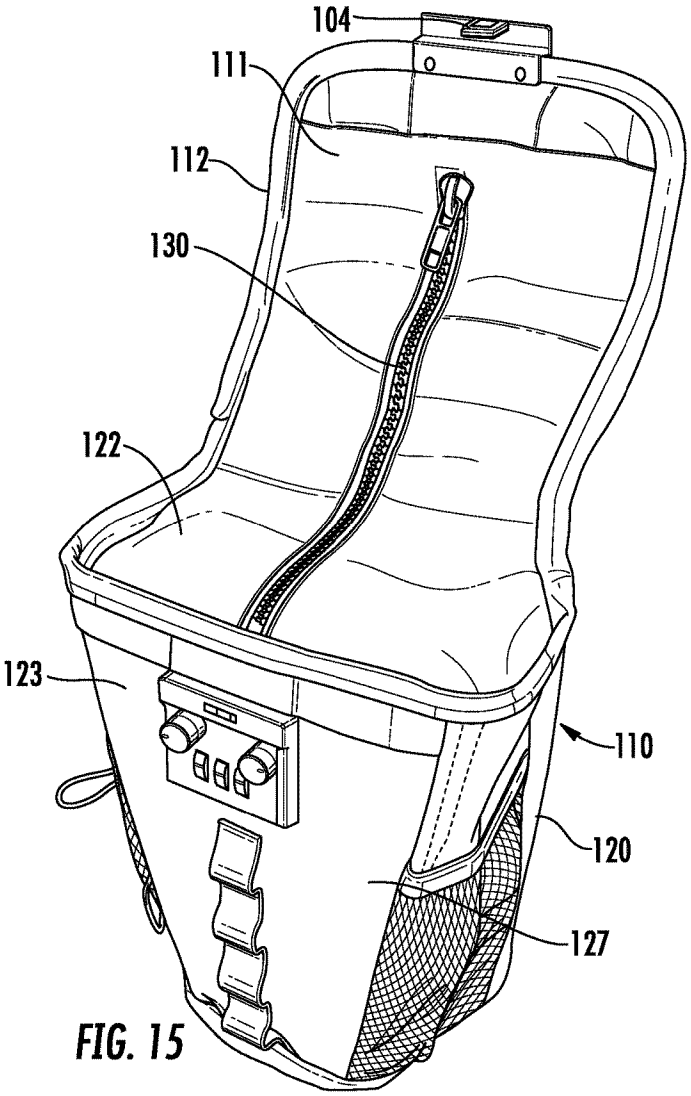
FIG. 15 is a front perspective view of the embodiment shown in FIG. 13 showing the flap component extended.

As shown in FIGS. 13 and 15, the free end of the flap component 112 preferably includes a clasp member 104 integrally connected thereto. The front surface 123 of the bottom component 120 includes at least a portion of the locking mechanism 102 thereon. As shown in FIG. 13, the clasp member 104 extends forwardly from the interior surface 111 of the flap component 112 when the flap component is extended upwardly in an open position. When the flap component 112 is folded and moved to a closed position wherein the side openings 116 and 117 are formed, the clasp member 104 is preferably positioned to extend into a recessed area 106 of the locking mechanism 102. As discussed above with respect to the prior embodiment, a variety of locking mechanisms may be used to secure the flap component 112 to the bottom component 120. In the form of the locking mechanism 102 shown with this embodiment, a combination lock type feature 108 with movable buttons 109 extends or retracts to engage the clasp member 104 in the recessed area 106 located along the front surface 123 of the bottom component 120.

The bottom component 120 of this embodiment includes an inner surface and an outer surface 127. In a preferred form of the present invention, the outer surface 127 of the bottom component 120 preferably includes a plurality of rings and/or mesh type pockets thereon the allow the user to secure the security bag to the strut of a bike, other means of transport or objects having an elongate support member prior to its use as a security bag and to carry cell phones or other items in an accessible manner during transport. Also as shown in the drawings, a handle type member 114 may extend from the top surface of the flap component 112 to provide the user with an element to grasp as the security bag 110 is transported. Similarly, a handle or clip member 115 may be located on the back surface of the security bag 110 to allow the security bag to be clipped to a surface during transport. Additionally, the security bag may be readily rolled up to provide for convenient transport prior to use.

As shown, the bottom component 120 has a generally rectangular or elongate lengthwise dimension to maximize the storage of valuables therein. The bottom component 120 is located below the top flap component 112 and below the side openings 116 and 117. The bottom component preferably has a greater top to bottom distance than the distance between the front 123 and back surface 121 or the width dimension. It is anticipated that the security bag 120 may be constructed in a variety of configurations depending on the intended use of the security bag to store different valuables. The height of the bottom component 120 is generally chosen to provide sufficient interior volume to accommodate the majority valuables typically carried by beach, park or pool goers. As with the flap component 112, the bottom component 120 preferably includes a greater side or lengthwise dimension than the width dimension from the front to back to provide a bottom component which extends along and is oriented along the lengthwise dimension of an elongate support bar. A preferred form of the lockable security bag preferably has a general dimension of approximately 10 inches tall with a depth dimension from the front surface 123 to the back surface of about 3 inches by about 6 inches wide at the top and about 4 inches wide at the bottom. An example of a preferred form of the present invention, the bottom of the interior surface area of the bottom component 120 and top section 112 of the lockable security bag 110 may be approximately 60 square inches to securely accommodate phones, wallets, sunglasses etc. from the typical user. Although not shown, the side or corner edges of the bottom component 120 may include reinforcing wires or threads to further reduce the ability of a person to tear or penetrate the security bag 110 of this embodiment and the security bag 110 may be rectangular or square in general overall shape.

The front surface 123 of the bottom component 120 includes at least a portion of the locking mechanism 102 thereon. The locking mechanism 102 generally includes the clasp member 104 on the top flap component 112 and the recessed area of the lock 106, combination lock 108 and buttons 109 located on the front surface 123 of the bottom component. As shown, the clasp member 104 may extend forwardly from the inner surface 118 of the flap component 112 in a manner to allow the positioning of the clasp 104 into the recessed area 106 of the locking mechanism 102 to securely close the lockable security bag 110. As also described above, the locking mechanism 102 may also consist of a self-contained lock similar to the types of locks used for bicycles, storage units or similar devices. In the present form of the locking mechanism 102, a combination lock type feature 108 controls the engagement of the clasp member 104 in the recessed area 106 and one or more buttons 109 may be manipulated to engage or release the clasp member 104.

FIGS. 13-16 are illustrative of the top and perspective views of the alternate embodiment of the present invention. FIG. 13 shows the use of a zippered closure 130 that provides further security for the contents of the security bag 110. The zippered closure 130 is preferably positioned longitudinally along the interior surface 111 of the top flap component to securely close the top of the bottom component 120 and provide a fully contained and enclosed storage cavity for the valuables of the user. In this embodiment, the zippered closure 130 extends from a location below the clasp member 104 on the top flap component to a location that is spaced apart slightly from the front surface 123 of the bottom component. The length of the zipper allows the opening to be sufficiently large to allow for the easy deposit and removal of the items that are to be secured inside the security bag 110. Additionally, the zippered closure is positioned to be spaced apart from the sides of the top flap component 112. This positioning of the zippered closure 130 prevents access to the zipper when the clasp member 104 is placed in the recessed area 106 of the lock. In the locked configuration of this embodiment, the location of the zipper closure 130 on the interior surface 111 of the top flap component 112 causes the zipper closure 130 to be positioned around the support member and spaced apart from the side openings 116 and 117 to prevent access to the zipper closure 130 through the side openings 116 and 117. This feature provides an additional level of security for the contents by preventing access to the zipper when the flap component is in the locked position while also not allowing a third party to see what is contained in the security bag 110.

In this alternate embodiment, the support bar B extends under the flap component 112 and above the bottom component 120 and through the side openings 116 and 117 to allow for the fixed object, such as the support bar, to center the gravitational pull of the bottom component 120 of the lockable security bag 110 and its contents to the middle of the support bar and security bag 110 eliminating lopsidedness. As shown and described above, this feature is accomplished through the flexibility and relative width of the flap component 112 as well as the preferably small amount of movement allowed along the interior surface 111 of the flap component 112. Because the lockable security bag 110 encloses around the support bar and the support bar has no free ends, the lockable security bag 110 is retained on the desired structure until the locking mechanism 102 of the security bag 110 is opened by the user. Similarly, because the components of the lockable security bag 110 are formed of a material that does not allow the contents of the bag to be visible therethrough and the zippered closure 130 is closable, there is nothing visible through the side openings 116 and 117 and the contents are not readily viewable without opening the lockable security bag.

What is claimed is:

1. A lockable security container comprising:

a flexible top component;

a bottom component having front, back and side surfaces wherein the length of the front and back surfaces is greater than the length of the side surfaces;

a storage cavity, which is formed in said bottom component and is made of said front, back and side surfaces and a bottom surface;

a closure member movable between first and second positions wherein access to the storage cavity is allowed in the first position thereof and obstructed in the second position thereof;

wherein said top component includes first and second ends and wherein said top component is movable between first and second positions and said first end attaches to said bottom component using a locking mechanism in the second position and wherein the combination of the top component and bottom component create a support cavity which is sized to receive a support bar therethough to facilitate the attachment of the security container to an external structure and wherein formation of the support cavity obstructs the visual observation of the closure member when the top component is in the second position;

said support cavity includes a plurality of side openings formed by said flexible top component in the second position of the top component; and wherein said storage cavity forms a closed storage area irrespective of the position of the top component.

2. The security container of claim 1 wherein the support cavity is sized to accommodate a variety of objects stored therein and said top and bottom components are formed of a flexible material.

3. The security container of claim 1 wherein the locking mechanism is a clasp lock, combination lock, or self-contained lock.

4. The security container of claim 1 wherein the length of the top component between the first and second ends is sufficient to hold an elongate support bar extending through side openings of the support cavity with sufficient structural integrity to support the weight of the lockable security container and the weight of objects stored in said lockable security container when the top component is in the second position.

5. The security container of claim 4 wherein the top component is a generally rectangular shaped member that is foldable over the support bar when the first end of the top component is affixed to the locking mechanism on the bottom component in the second position thereof.

6. The security container of claim 1 wherein the top component is a generally rectangular shaped member and has an elongate lengthwise dimension between the first and second ends and the top component forms a flexible and generally u-shape in cross sectional shape along the plane generally extending between the front surface and the back surface of the bottom component when the top component is attached to the bottom component in the second position of the top component.

7. The security container of claim 1 wherein the bottom component has a generally elongate lengthwise dimension between the sidewalls and is generally u-shaped in cross sectional shape along the plane generally extending between the front surface and the back surface of the bottom component and wherein the top surface of the storage cavity formed by a closure member that is to close the storage cavity and the closure member is located on an interior surface of the top component.

8. The security container of claim 1 wherein the top portion of the storage cavity of the bottom component is formed by a closable panel on an interior surface of the top component to allow the top portion of the storage cavity to be accessed or closed by movement of a closure member between open and closed positions and wherein the storage cavity may be in a closed configuration irrespective of the position of the top component.

9. The security container of claim 8 wherein the storage cavity is positioned below the top component when the top component is engaged in the locking mechanism in the second position of the top component.

10. The security container of claim 9 wherein access to the storage cavity is restricted when the top component is in the second position and access to the closure member is visually obstructed by the top component when the top component is in the second position.

11. A lockable security container comprising:

a flexible top component having first and second ends and an inner and outer surface;

a flexible bottom component having a storage cavity formed therein and includes bottom, front, back and side surfaces thereon;

a locking mechanism having complementary components located on the top component and bottom component;

a support cavity which is formable between the top component and bottom component when the locking mechanism of the top component is engaged in the locking mechanism of the bottom component and a pair of side openings are formed therebetween;

wherein the top surface of said bottom component is formed by an interior surface of the top component and is openable and closable with a closure member on the inner surface of the top component to allow access to the storage cavity in a first position thereof and restricts access thereto in a second position thereof and wherein the closure member may be in the second position irrespective of the position of the top component to restrict access to the storage cavity; and wherein the formation of the support cavity obstructs the visual observation of the closure member when the top component is engaged in the locking mechanism of the bottom component.

12. The security container of claim 11 wherein the locking mechanism is a clasp lock, combination lock, or self-contained lock.

13. The security container of claim 11 wherein the top component and bottom component are movable relative to an elongate object extending through said side openings formed when the top component is attached to the bottom component in the second position of the top component and the strength of the top component is sufficient to hold an elongate object extending through the support cavity with sufficient structural integrity to support the weight of the lockable security bag and the weight of objects stored in said storage cavity.

14. The security container of claim 11 wherein the top component when affixed to the bottom component by the locking mechanism is configured to provide secure engagement between the security container and an elongate object extending through said side openings of the support cavity.

15. The security container of claim 11 wherein the top component has a generally elongate lengthwise dimension between said side openings that are formed when the top component is engaged with the bottom component and is flexible, foldable and generally u-shaped in cross sectional shape along the plane generally extending between the front surface and the back surface of the top component when the top component is engaged with the bottom component and wherein the length of the front and back surfaces of the bottom component is greater than the length of the side surfaces and said second end of said top component is affixed to said back surface of said bottom component and said second end extends along substantially the entire lengthwise dimension of said back surface.

16. The security container of claim 11 wherein the inner surface of the top component includes a longitudinally aligned closure member thereon to form an opening into the bottom component.

17. A lockable security container comprising:

An elongate flexible top component;

a flexible bottom component having a storage cavity formed therein and includes top, bottom, front, back and side surfaces thereon and wherein at least a first portion of the top component is movable relative to the bottom component between first and second positions and a second portion of the top component is integrally connected to the bottom component;

a locking mechanism having complementary components located along the first portion of the top component and the front surface of the bottom component;

a support cavity having first and second ends and which is formable between the top component and bottom component when the locking mechanism of the first end of the top component is engaged in the locking mechanism of the bottom component and a pair of side openings are formed therebetween and said second end of said top component is affixed to said back surface of said bottom component;

wherein the top surface of said bottom component is formed by a movable flap located on the interior surface of the top component and the movable flap is openable and closable by the movement of a closure member thereon to allow access to the storage cavity in a first position thereof and prevents access thereto in a second position thereof and wherein access to the storage cavity may be obstructed irrespective of the position of the top component; and wherein the formation of the support cavity blocks visual observance of the closure member when the top component is engaged in the locking mechanism of the bottom component and the closure member remains movable irrespective of the position of the top component.

18. The security container of claim 17 wherein the top component has a lengthwise dimension between the first and second ends and the closure member is longitudinally aligned along an interior surface of the top component between the first and second ends thereof.

19. The security container of claim 18 wherein the top component is a generally rectangular shaped member that is foldable over the support bar and when the first end of the top component is affixed to the locking mechanism on the bottom component in the second position thereof the side openings are formed therebetween.

20. The security container of claim 18 wherein the top component is a generally rectangular shaped member and has a elongate lengthwise dimension between the first and second ends and the top component forms a flexible, foldable and generally u-shape in cross sectional shape along the plane generally extending between the front surface and the back surface of the bottom component when the top component is attached to the bottom component in the second position of the top component and wherein the length of the front and back surfaces of the bottom component is greater than the length of the side surfaces and said second end of said top component is affixed to said back surface of said bottom component and said second end extends along substantially the entire lengthwise dimension of said back surface.

* * * * *